US009905189B2

(12) United States Patent
Cho et al.

(10) Patent No.: US 9,905,189 B2
(45) Date of Patent: Feb. 27, 2018

(54) LIQUID CRYSTAL DISPLAY AND COMMON VOLTAGE COMPENSATION DRIVING METHOD THEREOF

(71) Applicant: LG Display Co., Ltd., Seoul (KR)

(72) Inventors: Soondong Cho, Gyeongsangbuk-do (KR); Juno Hur, Daegu (KR); Dongju Kim, Busan (KR)

(73) Assignee: LG Display Co., Ltd., Seoul (KR)

( * ) Notice: Subject to any disclaimer, the term of this patent is extended or adjusted under 35 U.S.C. 154(b) by 68 days.

(21) Appl. No.: 14/966,147

(22) Filed: Dec. 11, 2015

(65) Prior Publication Data

US 2016/0189662 A1 Jun. 30, 2016

(30) Foreign Application Priority Data

Dec. 24, 2014 (KR) ..... 10-2014-0188915

(51) Int. Cl.
*G09G 3/36* (2006.01)

(52) U.S. Cl.
CPC ..... *G09G 3/3696* (2013.01); *G09G 3/3648* (2013.01); *G09G 3/3655* (2013.01); *G09G 3/3681* (2013.01); *G09G 2330/02* (2013.01); *G09G 2330/021* (2013.01); *G09G 2330/025* (2013.01)

(58) Field of Classification Search
CPC .. G09G 3/3655; G09G 3/3696; G09G 3/3648; G09G 3/3681; G09G 2330/02; G09G 2330/021; G09G 2330/025; G09G 2330/026
See application file for complete search history.

(56) References Cited

U.S. PATENT DOCUMENTS 5,175,535 A 12/1992 Yamazaki et al.
8,878,881 B2 * 11/2014 Li ..... G09G 3/3607 345/211
2006/0050042 A1 * 3/2006 Yi ..... G09G 3/3696 345/98
2006/0145995 A1 * 7/2006 Kim ..... G09G 3/3655 345/98
2008/0198124 A1 * 8/2008 Kojima ..... G09G 3/3655 345/96
2008/0278471 A1 11/2008 Huang
2010/0033413 A1 2/2010 Song et al.
2010/0033475 A1 * 2/2010 Choi ..... G09G 3/3648 345/214
2010/0321359 A1 * 12/2010 Liu ..... G09G 3/3655 345/209

(Continued)

OTHER PUBLICATIONS

Communication dated May 20, 2016 from the European Patent Office in counterpart European application No. 15200709.2.

*Primary Examiner* — Darlene M Ritchie
(74) *Attorney, Agent, or Firm* — Morgan, Lewis & Bockius LLP

(57) ABSTRACT

A liquid crystal display device includes a liquid crystal panel configured to display an image, a driver configured to drive the liquid crystal panel, a timing controller configured to control the driver, and a power supply configured to be supplied by an input voltage, supply a common voltage to the liquid crystal panel, and temporarily vary a compensation ratio of the common voltage when a pattern causing a drop of the input voltage is displayed by the display device.

8 Claims, 9 Drawing Sheets

(56) References Cited

U.S. PATENT DOCUMENTS

| | | | | |
|---|---|---|---|---|
| 2011/0175876 | A1* | 7/2011 | Chang | G09G 3/3655 345/211 |
| 2012/0218250 | A1* | 8/2012 | Pei | G09G 3/3655 345/212 |
| 2013/0088476 | A1* | 4/2013 | Yamagishi | G09G 3/3648 345/211 |
| 2013/0314393 | A1* | 11/2013 | Min | G09G 3/36 345/212 |
| 2016/0086542 | A1* | 3/2016 | Lee | G09G 3/2022 345/212 |
| 2016/0149574 | A1* | 5/2016 | Cui | H03K 19/00369 327/513 |
| 2016/0260407 | A1* | 9/2016 | Zheng | G09G 3/3614 |

* cited by examiner (a)

(b)

LIQUID CRYSTAL DISPLAY AND COMMON VOLTAGE COMPENSATION DRIVING METHOD THEREOF

This application claims the benefit of Korean Patent Application No. 10-2014-0188915, filed on Dec. 24, 2014, which is incorporated herein by reference for all purposes as if fully set forth herein.

BACKGROUND

Field

The present disclosure relates to a liquid crystal display and a driving method thereof.

Description of the Related Art

As information technology has advanced, the market of display devices as mediums for connecting users with information has grown. In line with this, the use of flat panel displays (FPDs) such as liquid crystal displays (LCDs), organic light emitting display devices, and plasma display panels (PDPs) has increased. Among them, LCDs, capable of implementing high resolution and both reductions and increases in size, have been widely used.

An LCD typically includes a liquid crystal panel and a backlight unit. The liquid crystal panel typically includes a transistor substrate in which thin film transistors (TFTs), storage capacitors, and pixel electrodes are formed, a color filter substrate in which color filters and a black matrix are formed, and a liquid crystal layer positioned between the transistor substrate and the color filter substrate.

The liquid crystal panel, displaying an image, is typically operated by a gate driver supplying a gate signal, a data driver supplying a data signal, and a power supply unit supplying a common voltage, or the like. In the liquid crystal layer, liquid crystal moves to correspond to an electric field generated between a pixel voltage and a common voltage.

In the LCD, a load may be determined according to patterns displayed on the liquid crystal panel, and power consumption varies depending on the load. For example, when the LCD displays a maximum ("max") pattern in which an image fully transitions during one frame, the data driver may consume power twice to thrice as much as that of a case in which a normal pattern is displayed.

In addition to increasing the power consumption, such a max pattern displayed on the liquid crystal panel may cause heat generation and degradation of other characteristics of the device. Thus, a scheme for solving the problems arising when a max pattern is generated is proposed.

The proposed scheme may advantageously reduce power consumption by changing a driving algorithm, but has the tendency of causing a voltage drop in an input terminal of the power supply unit when power is turned on in a state in which the max pattern is applied. In addition, when the voltage drop increases, an under-voltage lock-out (UVLO) of the power supply unit may occur, making the device inoperative. Due to such various problems, the proposed scheme may be improved.

SUMMARY

In an aspect of the present disclosure, there is provided a liquid crystal display device including a liquid crystal panel configured to display an image, a driver configured to drive the liquid crystal panel, a timing controller configured to control the driver, and a power supply. The power supply is configured to be supplied by an input voltage, supply a common voltage to the liquid crystal panel, and temporarily vary a compensation ratio of the common voltage when a pattern causing a drop of the input voltage is displayed by the display device.

In another aspect, there is provided a method for driving a liquid crystal display device, the method comprising turning on power so that an external input voltage is supplied to a power supply, varying a compensation ratio of a common voltage output from the power supply during a first period of time, and returning the compensation ratio of the common voltage output from the power supply to an original compensation ratio thereof during a second period of time that is after the first period of time.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompany drawings, which are included to provide a further understanding of the disclosure, and are incorporated in and constitute a part of this specification, illustrate embodiments of the disclosure and together with the description serve to explain the principles of the disclosure.

DETAILED DESCRIPTION OF DISCLOSED EMBODIMENTS

Reference will now be made in detail embodiments of the disclosure examples of which are illustrated in the accompanying drawings.

First Example Embodiment

Figure 1:
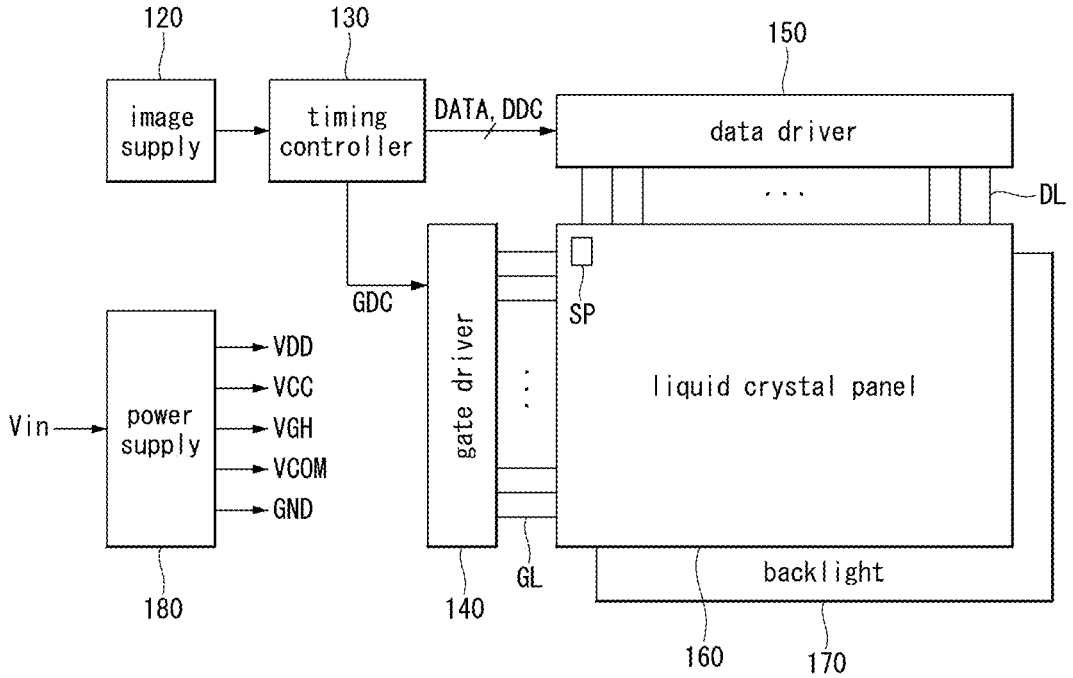
FIG. 1 is a block diagram schematically illustrating an example of a liquid crystal display (LCD) device.

FIG. 1 is a block diagram schematically illustrating an example of a liquid crystal display (LCD) device, and FIG.

2 is a circuit diagram schematically illustrating an example of a sub-pixel (SP) as illustrated in FIG. 1.

As illustrated in FIG. 1, the LCD device includes an image supply unit 120, a timing controller 130, a gate driver 140, a data driver 150, a liquid crystal panel 160, a backlight unit 170, and a power supply unit 180.

The image supply unit 120 processes a data signal and outputs the data signal together with a vertical synchronization signal, a horizontal synchronization signal, a data enable signal, and a clock signal. The image supply unit 120 supplies the vertical synchronization signal, the horizontal synchronization signal, the data enable signal, the clock signal, and the data signal to the timing controller 130.

The timing controller 130 generates a gate timing control signal GDC for controlling an operation timing of the gate driver 140 and a data timing control signal DDC for controlling an operation timing of the data driver 150 on the basis of various signals supplied from the image supply unit 120, and outputs the generated gate timing control signal GDC and the data timing control signal DDC. The timing controller 130 supplies a data signal (or a data voltage), supplied from the image processing unit 110 to the data driver 150, together with the data timing control signal DDC.

In response to the gate timing control signal GDC, the gate driver 150 outputs a gate signal while shifting a level of a gate voltage. The gate driver 140 supplies a gate signal to subpixels SP included in the liquid crystal panel 160 through gate lines GL (see FIG. 2). The gate driver 140 may be formed as an integrated circuit (IC) or in a gate-in-panel manner in the liquid crystal panel 160.

In response to the data timing control signal DDC supplied from the timing controller 130, the data driver 150 samples, latches, and converts a data signal DATA into a gamma reference voltage, and outputs the same. The data driver 150 supplies the data signal DATA to the subpixels SP included in the liquid crystal panel 160 through data lines DL (see FIG. 2). The data driver 150 is formed as an IC.

The liquid crystal panel 160 displays an image in response to a gate signal output from drivers, including the gate driver 140 and the data driver 150, and a common voltage that may be output from the power supply unit 180. The liquid crystal panel 160 includes subpixels SP controlling light provided from the backlight unit 170.

Figure 2:
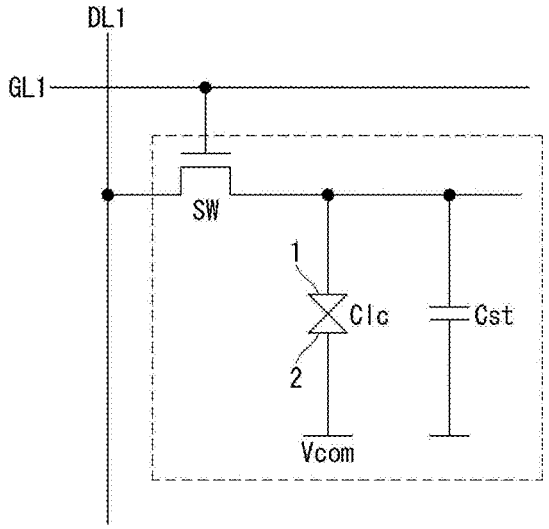
FIG. 2 is a circuit diagram schematically illustrating an example sub-pixel as shown in FIG. 1.

With reference to FIG. 2, a single subpixel includes a switching transistor SW, a storage capacitor Cst, and a liquid crystal layer Clc. A gate electrode of the switching transistor SW is connected to a gate line GL1, and a source electrode thereof is connected to a data line DL1. The storage capacitor Cst is connected to a drain electrode of the switching transistor SW at one end thereof and is connected to a common voltage line Vcom at the other end thereof. The liquid crystal layer Clc is formed between a pixel electrode 1 connected to the drain electrode of the switching transistor SW and a common electrode 2 connected to the common voltage line Vcom.

The liquid crystal panel 160 may be implemented in a twisted nematic (TN) mode, a vertical alignment (VA) mode, an in-plane switching (IPS) mode, a fringe field switching (FFS) mode, or an electrically controlled birefringence (ECB) mode, according to the structures of the pixel electrode 1 and the common electrode 2.

The backlight unit 170 provides light to the liquid crystal panel 160 using a light source that outputs light. The backlight unit 170 may include a light emitting diode (LED), an LED driver driving the LED, an LED board on which the LED is mounted, a light guide plate converting light output from the LED into a surface light source, a reflective plate reflecting light from below the light guide plate, and optical sheets collecting and diffusing light output from the light guide plate.

The power supply unit 180 generates various types of power on the basis of an input voltage Vin supplied from the outside, and outputs the same. The power supply unit 180 generates a first source voltage VDD, a second source voltage VCC, a gate high voltage VGH, a common voltage VCOM, and a low potential voltage GND. The first source voltage VDD may be supplied to the data driver 150, the second source voltage VCC may be supplied to the timing controller 130, the gate high voltage VGH may be supplied to the gate driver 140, and the common voltage VCOM may be supplied to the liquid crystal panel 160. In the present disclosure, for example, the power supply unit 180 may generate all of the voltages described above. However, this is merely illustrative, and the power supply unit 180 may be configured differently according to a configuration of the display device or voltage levels.

The LCD device described above may display an image through the liquid crystal panel 160 by interworking without the gate driver 160 supplying a gate signal, the data driver 150 supplying a data signal DATA, and the power supply unit 180 supplying the common voltage VCOM, or the like.

In the LCD device, a load may be determined according to patterns displayed on the liquid crystal panel 160, and power consumption of the device is varied by the load. For example, when the LCD device displays a max pattern in which an image full-transitions during one frame, the data driver 150 may consume power twice to thrice greater as compared to a case in which a normal pattern is displayed.

In addition to increasing power consumption, such a max pattern displayed on the liquid crystal panel 160 may cause heat generation and degradation of other characteristics of the device. Thus, a scheme for solving the problems arising when the max pattern is generated is proposed.

Figure 3:
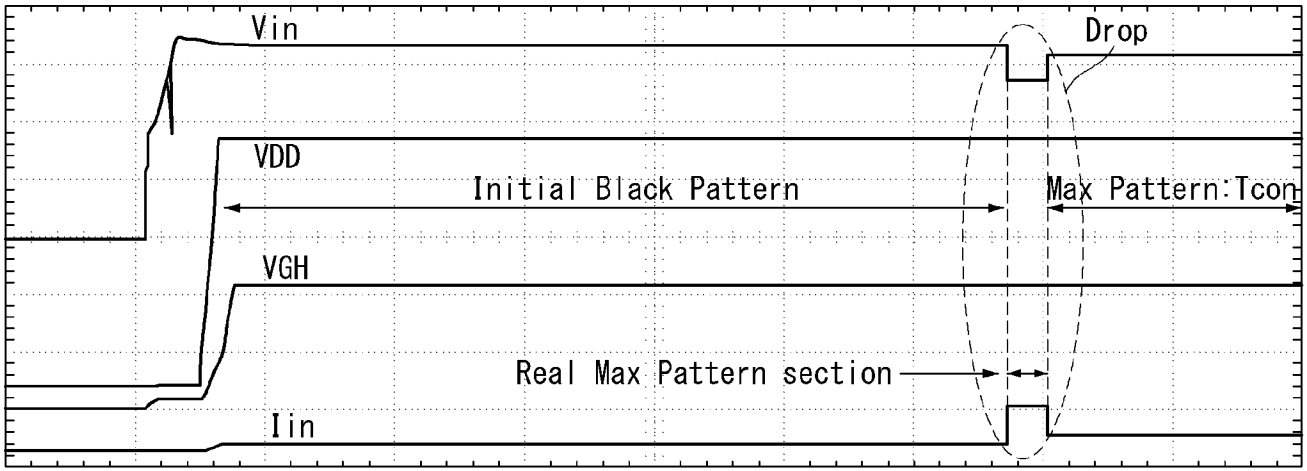
Fig. 3 (Related Art)
FIG. 3 is a waveform view illustrating output states of a power supply unit of a proposed scheme according to the related art.
Figure 4:
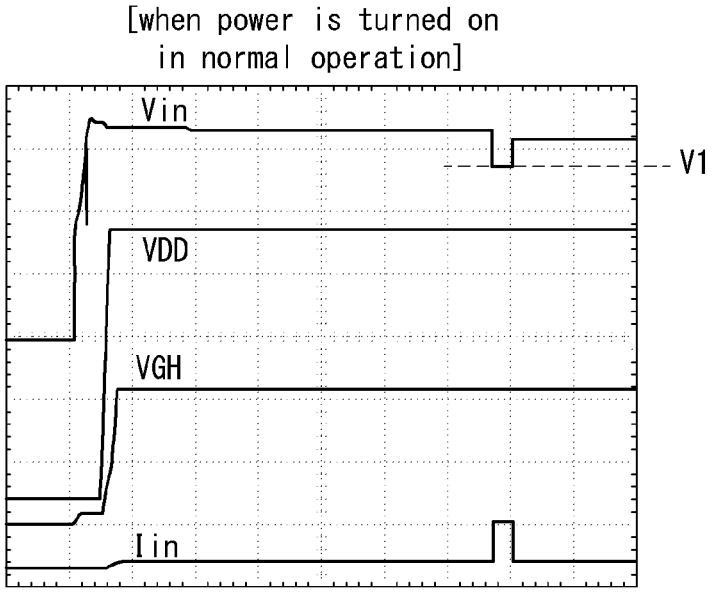
Fig. 4 (Related Art)
FIG. 4 is a waveform view illustrating output states of the power supply unit of a related art LCD device when the power supply unit of the related art LCD device performs a normal operation and an abnormal operation.
Figure 4:
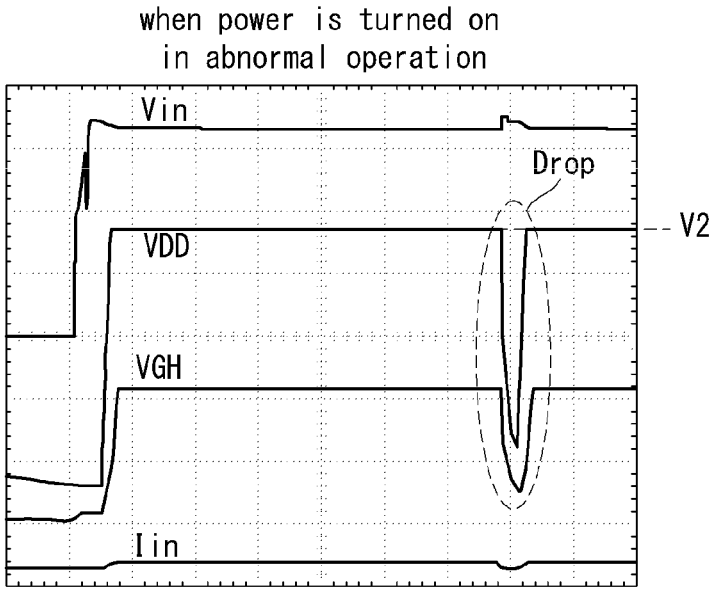
Fig. 4 (Related Art)

FIG. 3 is a waveform view illustrating output states of a power supply unit to briefly explain a proposed scheme of related art, and FIG. 4 is a waveform view illustrating output states of the power supply unit of a related art LCD device when its power supply unit performs a normal operation and an abnormal operation.

As illustrated in FIGS. 3 and 4, in the related art, in order to solve a problem of a voltage drop due to a max pattern (real max pattern section) when the LCD device is initially driven, a scheme of changing a driving algorithm of a timing controller Tcon is proposed. For example, the max pattern appears after an initial black pattern is displayed for a predetermined period of time. However, an increase in power consumption or heat generation and degradation of other characteristics of the device are resolved, to a degree, by the driving algorithm of the timing controller Tcon.

In FIGS. 3 and 4, Vin denotes an input voltage input to the power supply unit, VDD denotes a first source voltage, VGH denotes a gate high voltage, and Iin denotes an input current input to the power supply unit.

In this manner, the proposed scheme of the related art is advantageous in that it reduces power consumption. However, as illustrated in plot (b) of FIG. 4, when power is turned on in a state in which the max pattern is applied, a voltage drop (e.g., when an amount of drop during a normal operation is V1 (plot (a)), an amount of drop during an abnormal operation is as severe as V2 (plot (b)) tends to occur in an input terminal of the power supply unit. Also, when the voltage drop increases, under-voltage lock out (UVLO) of the power supply unit may operate to put the device into a state in which the device cannot normally operate. Thus, the proposed scheme of the related art could use improvement.

Figure 5:
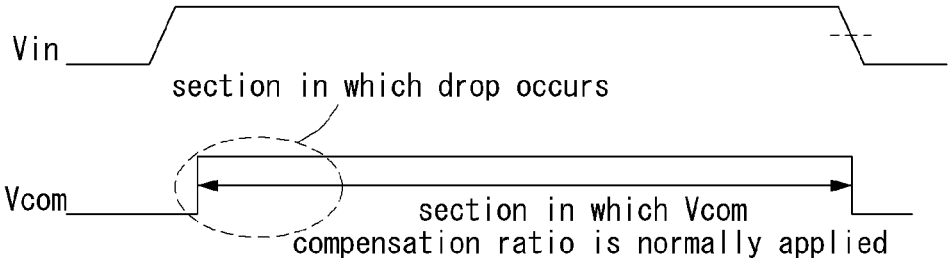
Fig. 5 (Related Art)
FIG. 5 is a waveform view illustrating a possible problem of the related art.
Figure 6:
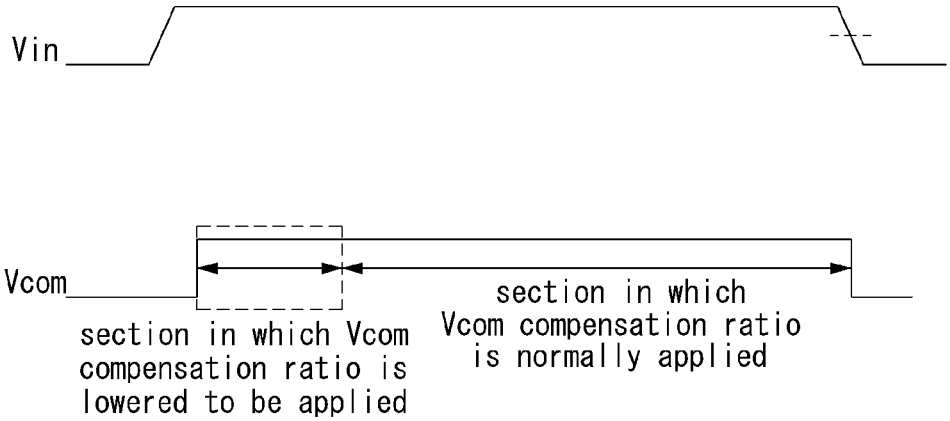
FIG. 6 is a waveform view illustrating a first example embodiment of the present disclosure.
Figure 7:
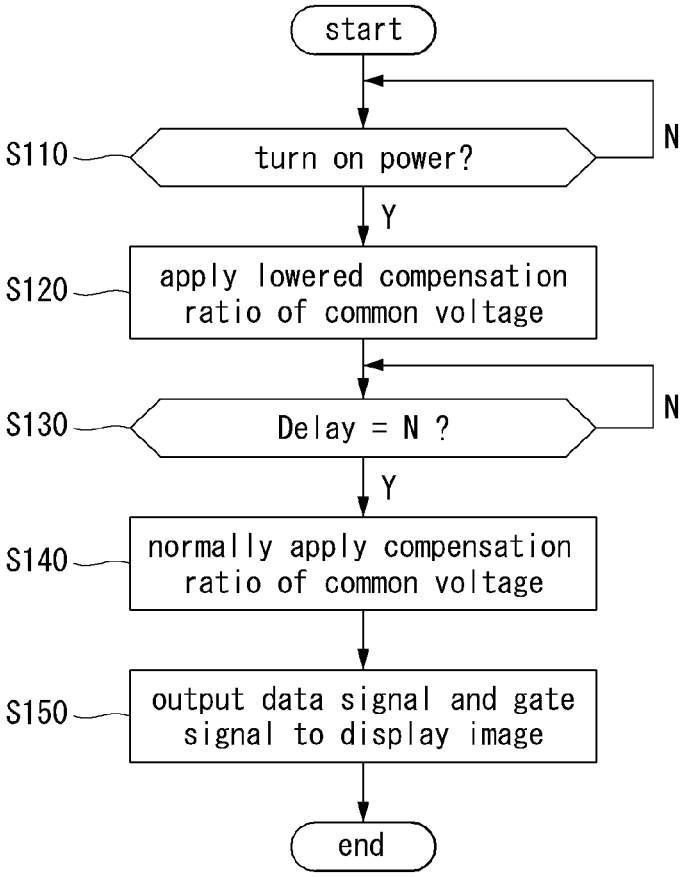
FIG. 7 is a flow chart illustrating a method for driving an LCD device according to an example of the first embodiment of the present disclosure.

FIG. 5 is a waveform view of voltages which illustrate a problem of the related art, FIG. 6 is a waveform view of voltages which illustrates a first example embodiment of the present disclosure to improve the problem of the related art, and FIG. 7 is a flow chart illustrating a method for driving an LCD device according to the first example embodiment of the present disclosure.

The proposed scheme of the related art may improve the problems of the increase in power consumption, the heat generation, and the degradation of other characteristics of the device due to the max pattern, to a degree. However, when power is turned on in a state in which the max pattern is applied, a voltage drop may occur in the input terminal of the power supply unit, and when the voltage drop increases, the under-voltage lock-out (UVLO) of the power supply unit may operate, thereby making it impossible for the device to normally operate. Analysis results reveal that causes of the voltage drop were related to a compensation problem of a common voltage used in the LCD device.

As illustrated in FIG. 5, in the proposed scheme of the related art, when the input voltage Vin is supplied to the power supply unit, the power supply unit compensates for the common voltage Vcom with a predetermined compensation ratio, and outputs the same. That is, in such a proposed scheme, an increase in current according to the compensation operation of a common voltage amplifying unit (e.g., an operational amplifier for Vcom) included in the power supply unit may be the main cause of the increase in power consumption for the max pattern. A degree of the increase in current may be varied according to compensation ratios of the common voltage amplifying unit. For this reason, when power is turned on in a state in which the max pattern is applied, the voltage drop may occur in connection with the common voltage compensation operation of the power supply unit.

As illustrated in FIG. 6, in order to improve the problem arising in the proposed scheme of the related art, in a first example embodiment of the present disclosure, when the input voltage Vin is supplied to the power supply unit, a common voltage compensation ratio to be applied is lowered for a predetermined period of time. After the predetermined period of time has lapsed, a previously set value of the common voltage compensation ratio is normally applied such that the common voltage Vcom may be output at a predetermined compensation ratio from the power supply unit.

For example, in the proposed scheme of the related art, in order to improve crosstalk, a common voltage compensation ratio of twenty times or greater, compared with that of normal driving, may be applied. However, in the first example embodiment of the present disclosure, the common voltage compensation ratio applied may be less than half of twenty times that of normal driving. For example, in the first example embodiment of the present disclosure, the common voltage compensation ratio of M times (where M is 1 to 10 times) may be applied.

Meanwhile, in the first example embodiment of the present disclosure, when the device was initially driven, the common voltage compensation ratio was, at one time, in a state in which a special pattern such as the max pattern was displayed, but an abnormal screen problem of the display panel did not occur. Thus, in the first example embodiment of the present disclosure, when the device is initially driven, the common voltage amplifying unit of the power supply unit may compensate for the common voltage with a first compensation ratio, and thereafter, the common voltage may be compensated with a second compensation ratio. Here, the first compensation ratio is lower than the second compensation ratio by M times (M is 1 to 10 times).

In this manner, in the first example embodiment of the present disclosure, when power of the LCD device is turned on, the common voltage compensation ratio performed by the common voltage amplifying unit of the power supply unit may be temporarily lowered to improve a voltage margin and resolve the voltage drop, thus preventing a problem in which the UVLO of the power supply unit operates.

To this end, as illustrated in FIG. 3, the common voltage compensation ratio may be applied by M times (for example, one time) in a first section (or an initial section) in which initial black data and a real max pattern are generated. Thereafter, in the second section (after the section in which the initial black data and the real max pattern are generated is terminated), the common voltage compensation may be applied as a normal compensation ratio (e.g., a preset compensation ratio or the original compensation ratio).

The timing controller may generate a signal capable of controlling the common voltage compensation ratio and outputting the same to the power supply unit, or may vary the signal supplied to the power supply unit. For example, in a case in which the timing controller and the power supply unit are connected as a communication interface of I2C protocol, and the common voltage compensation ratio of the power supply unit is set to one time, the timing controller may output a control signal through I2C after the lapse of a predetermined delay time.

As illustrated in FIG. 7, the LCD device according to the first example embodiment of the present disclosure may operate as follows.

Power is turned on so that an input voltage, generated by an external source, is supplied to the power supply unit (S110). When power is turned on (Y), it means (for example) that a user turned on power of the LCD device, and when power is not turned on (N), it means (for example) that the user did not turn on power of the LCD device.

When the input voltage generated by an external source is supplied to the power supply unit, the power supply unit lowers a compensation ratio of a common voltage and applies the lowered compensation ratio (S120).

The power supply unit lowers the common voltage compensation ratio during an 'N' amount of time (a first section or a first time) (S130). For example, under the control of the timing controller, the power supply unit lowers the common voltage compensation ratio during N time (N time corresponds to the sum of sections in which initial black data and the max pattern are generated). Here, when the N time has not lapsed (N), the common voltage compensation ratio is lowered to be applied until the N time lapses.

When the N time has lapsed (Y) (a second section or a second time positioned after the first section), the power supply unit normally applies the compensation ratio of the common voltage. When the compensation ratio is normally applied, it may mean that a preset compensation ratio or the original compensation ratio is restored.

Through the foregoing operation, the problem that may arise during an initial operation in relation to the compensation ratio for the common voltage output from the power supply unit may be solved. Thus, the LCD device may perform a normal operation, such as displaying an image on the display panel in response to a data signal, a gate signal, or a common voltage (S150).

Hereinafter, a common voltage generation unit of the related art as described above, and that of a first example embodiment of the present disclosure will both be described.

Figure 8A:
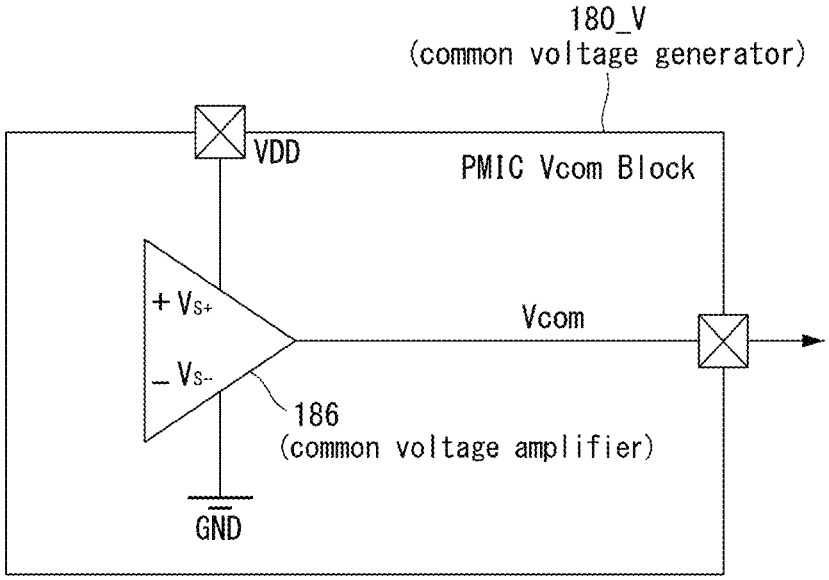
Fig. 8A (Related Art)
FIGS. 8A and 8B are block diagrams illustrating a comparison between common voltage generating units according to the first example embodiment of the present disclosure and the related art.
Figure 8B:
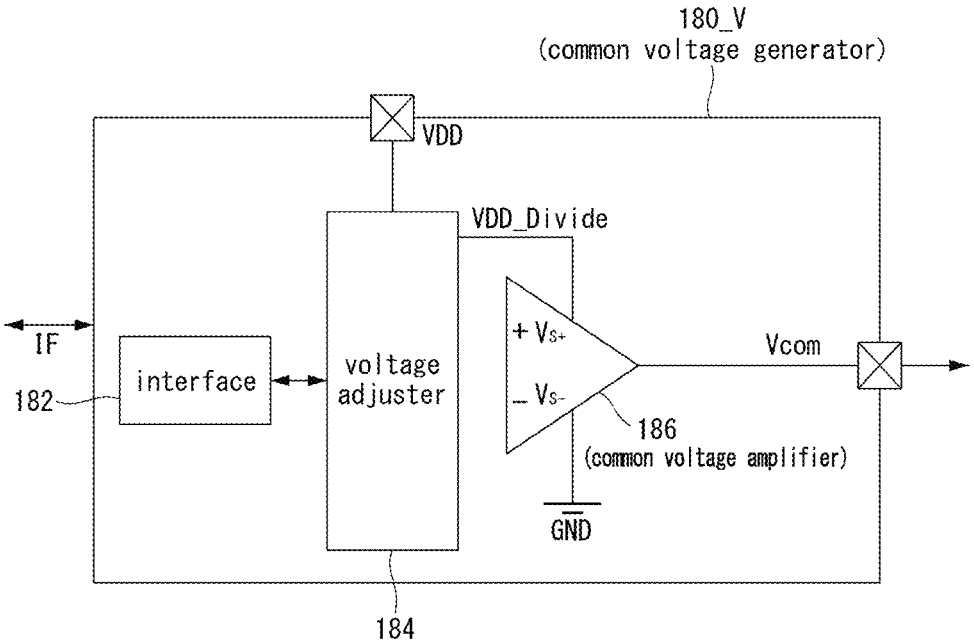
Figure 9:
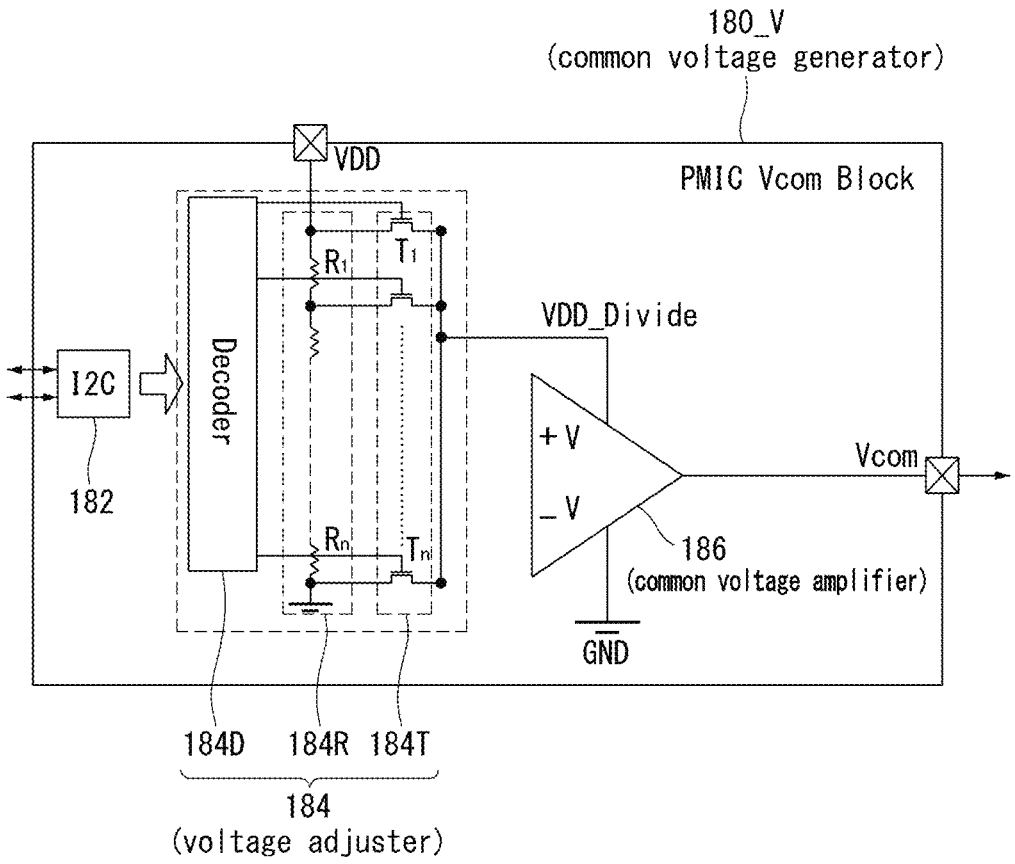
FIG. 9 is a block diagram illustrating an example of the common voltage generating unit according to the first example embodiment of the present disclosure.

FIGS. 8A and 8B are a block diagrams illustrating a comparison between common voltage generating units of the related art and the first example embodiment of the present disclosure, and FIG. 9 is a block diagram specifically illustrating the common voltage generating unit according to the first example embodiment of the present disclosure.

As illustrated in FIG. 8A, the common voltage generation unit 180_V according to the related art includes a common voltage amplifying unit 186 amplifying a common voltage Vcom and outputting the amplified common voltage. The common voltage amplifying unit 186 amplifies the common voltage Vcom on the basis of a first source voltage VDD and a low potential voltage GND.

The common voltage generation unit 180_V according to the related art may vary a compensation ratio of the common voltage in response to a voltage or a signal supplied to a non-inverting terminal (+) and an inverting terminal (−) of the common voltage amplifying unit 186.

As illustrated in FIG. 8B, a common voltage generation unit 180_V according to the first example embodiment of the present disclosure may include an interface unit 182, a voltage adjuster 184, and a common voltage amplifying unit 186.

The interface unit 182 may exchange data with an external circuit unit (hereinafter referred to as a "timing controller") according to a communication interface (IF) scheme. For example, the interface unit 182 may receive a power control signal through a communication interface (IF) with the timing controller, and deliver the received power control signal to the voltage adjusting unit 184.

The voltage adjuster 184 may vary a first source voltage VDD and output the same. In response to a power control signal transferred through the interface unit 182, the voltage adjuster 184 may vary the first source voltage VDD and output the varied voltage. For example, in response to the power control signal transferred through the interface unit 182, the voltage adjuster 184 may divide the first source voltage VDD and deliver the divided voltage to the common voltage amplifying unit 186. The voltage adjuster 184 serves to limit the first source voltage VDD supplied to the common voltage amplifying unit 186 (or lowers a level of the first source voltage and outputs the same).

The common voltage amplifying unit 186 may amplify the common voltage Vcom on the basis of the first source voltage VDD, delivered from the voltage adjuster 184, and a low potential voltage GND, and output the amplified voltage. The first source voltage VDD, delivered from the voltage adjuster 184, is supplied to a first bias terminal Vs+, and the low potential voltage GND is supplied to a second bias terminal Vs−. For example, in response to a varied level of the first source voltage VDD delivered from the voltage adjuster 184, the common voltage amplifying unit 186 may vary a compensation ratio (or an amplification ratio) of the common voltage Vcom, and output the varied compensation ratio through a common voltage line.

As can be seen from FIGS. 8A-8B, in the first example embodiment of the present disclosure, the compensation ratio of the common voltage may be varied in response to the power control signal supplied from an external source, in contrast to the related art. An example of the voltage adjusting unit illustrated in FIG. 8B and described above will be further described as follows.

As illustrated in FIG. 9, the example voltage adjusting unit 184 includes a decoder unit 184D, a resistor string unit 184R, and a transistor unit 184T. The decoder unit 184D generates an output in response to a power control signal. The resistor string unit 184R includes a plurality of resistors arranged between the first source voltage VDD and the low potential voltage GND. In response to a signal output from the decoder unit 184D, the transistor unit 184T controls the resistor string unit 184R and varies the first source voltage VDD, and outputs the same.

The voltage adjusting unit 184 includes the transistor unit 184T capable of controlling the resistor string unit 184R positioned between the first source voltage VDD and the low potential voltage GND in response to the power control signal delivered to the decoder unit 184D. The voltage adjusting unit 184 may control a circuit configured with the decoder unit 184D, the resistor string unit 184R, and the transistor unit 184T, in response to a power control signal, and may vary the first source voltage VDD in such a manner that a resistance value between the first source voltage VDD and the low potential voltage GND is varied, and output the same. However, the above description is merely illustrative, and the present disclosure is not limited thereto.

As described above, the first example embodiment of the present disclosure may include a common voltage generation unit 180_V capable of varying a compensation ratio (or an amplification ratio) of the common voltage Vcom.

Therefore, in a case in which the common voltage generation unit 180_V according to the first example embodiment is used, when power of the LCD device is turned on, a common voltage compensation ratio carried out in the common voltage amplifying unit 186 of the power supply unit (PMIC Vcom Block) may be temporarily lowered to improve a voltage margin and resolve a voltage drop, thus preventing a problem in which UVLO is applied to the power supply unit.

Meanwhile, the first example embodiment of the present disclosure may improve a problem caused by a special pattern such as a max pattern, or the like, when the LCD device is initially driven. However, the special pattern such as the max pattern may also be generated even after the LCD device is initially driven. In order to cope with such a case, the present disclosure proposes a scheme of changing a compensation ratio of a common voltage even while the LCD device is being driven.

Second Example Embodiment

Figure 10:
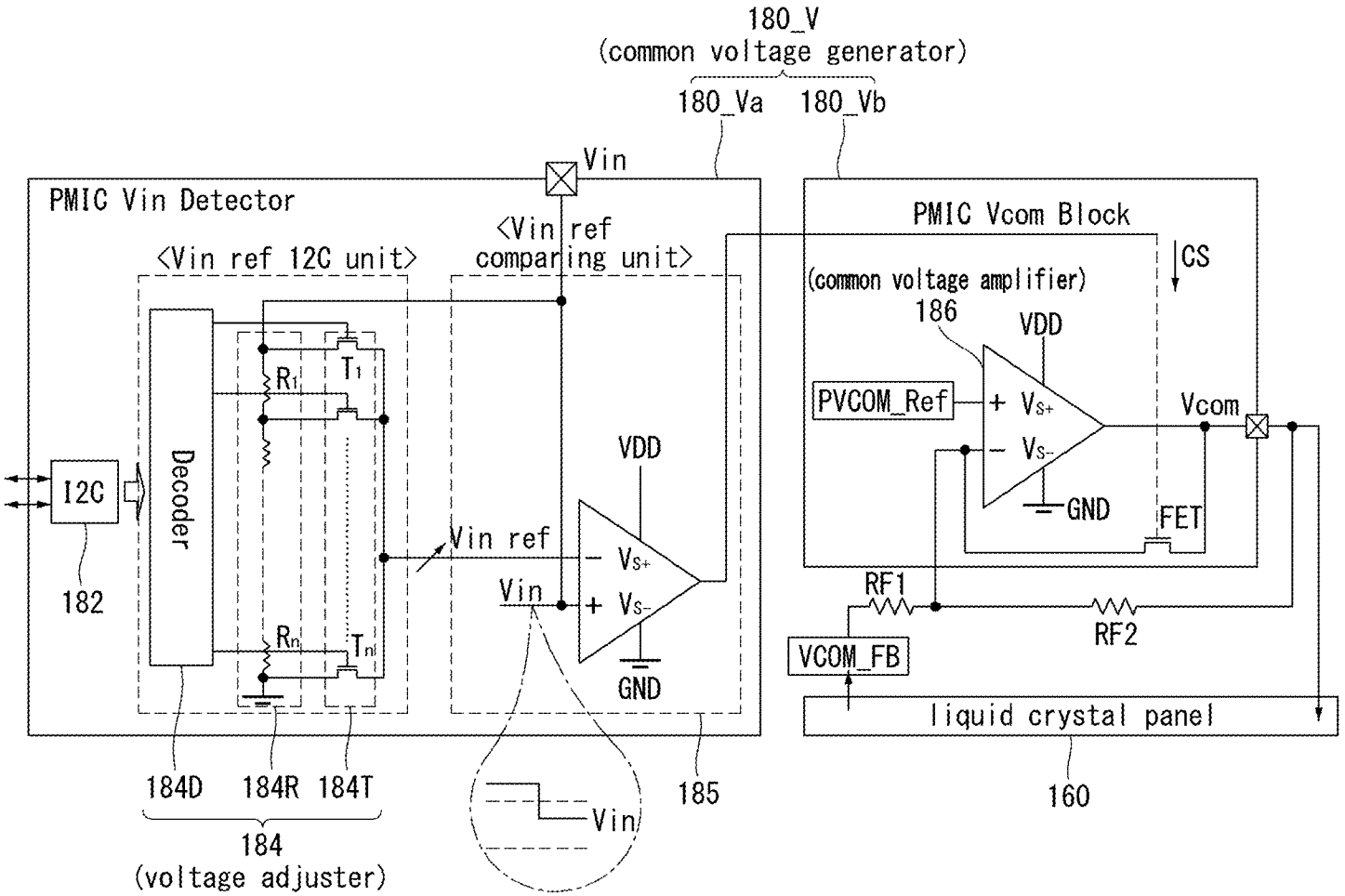
FIG. 10 is a block diagram illustrating an example of a portion of the common voltage generating unit according to a second example embodiment of the present disclosure.

FIG. 10 is a block diagram illustrating a portion of an example common voltage generating unit according to a second example embodiment of the present disclosure.

As illustrated in FIG. 10, the common voltage generation unit 180_V includes a first circuit unit 180_Va (PMIC Vin Detector) detecting an input voltage, and a second circuit unit 180_Vb (PMIC Vcom Block) generating a common voltage Vcom.

The first circuit unit 180_Va outputs a control signal CS for controlling a compensation ratio of the common voltage Vcom output from the second circuit unit 180_Vb on the basis of a signal supplied from an external circuit unit and an input voltage Vin supplied from the outside.

The first circuit unit 180_Va includes an interface unit 182, a voltage adjusting unit 184, and a voltage comparing unit 185. The interface unit 182 exchanges data with an external circuit unit (hereinafter, referred to as a "timing controller") according to a communication interface (IF) scheme. For example, the interface unit 182 receives a power control signal through a communication interface (IF)

with the timing controller, and delivers the received power control signal to the voltage adjusting unit 184.

The voltage adjusting unit 184 varies a reference voltage Vin ref of the input voltage and outputs the varied reference voltage. Here, in response to the power control signal delivered through the interface unit 182, the voltage adjusting unit 184 varies the reference voltage Vin ref of the input voltage and outputs the varied reference voltage. For example, in response to the power control signal delivered through the interface unit 182, the voltage adjusting unit 184 divides the input voltage Vin and delivers the divided input voltage Vin to the voltage comparing unit 185. The voltage adjusting unit 184 serves to limit the reference voltage Vin ref of the input voltage supplied to the voltage comparing unit 185 (or lowers a level of a first source voltage and outputs the same).

The voltage adjusting unit 184 includes a decoder unit 184D, a resistor string unit 184R, and a transistor unit 184T. The voltage adjusting unit 184 includes the transistor unit 184T, which is capable of controlling the resistor string unit 184R positioned between the input voltage Vin and a low potential voltage GND in response to the power control signal delivered to the decoder unit 184D.

The voltage adjusting unit 184 may control a circuit including the decoder unit 184D, the resistor string unit 184R, and the transistor unit 184T, in response to the power control signal, and may vary the reference voltage Vin ref of the input voltage in such a manner that a resistance value between the input voltage Vin and the low potential voltage GND is varied, and output the same. The voltage adjusting unit 184 may vary (or limit) the reference voltage Vin ref of the input voltage by models of liquid crystal panels in response to the power control signal. However, this is merely illustrative and the present disclosure is not limited thereto.

The voltage comparing unit 185 compares the reference voltage Vin ref of the input voltage delivered from the voltage adjusting unit 184 with the input voltage Vin supplied from the outside, and outputs a control signal CS according to the comparison result. The reference voltage Vin ref of the input voltage delivered from the voltage adjusting unit 184 is supplied to an inverting terminal (−) of the voltage comparing unit 185, the input voltage Vin is supplied to a non-inverting terminal (+) of the voltage comparing unit 185, the first potential voltage VDD is supplied to a first bias terminal (Vs+), and the low potential voltage is supplied to a second bias terminal (Vs−).

When a drop occurs in the input voltage Vin due to a special pattern such as a max pattern, the voltage comparing unit 185 outputs a control signal CS according to a preset voltage. For example, when a level of the input voltage Vin is higher than that of the reference voltage Vin ref of the input voltage, the voltage comparing unit 185 outputs a control signal CS corresponding to a logic low signal Low. Meanwhile, when a level of the input voltage Vin is lower than that of the reference voltage Vin ref of the input voltage, the voltage comparing unit 185 outputs a control signal CS corresponding to a logic high signal High.

The second circuit unit 180_Vb controls a compensation ratio of the common voltage Vcom in response to the control signal CS supplied from the first circuit unit 180_Va. The second circuit unit 180_Vb includes a common voltage amplifying unit 186 amplifying a common voltage and outputting the amplified common voltage and a switch unit FET controlling a compensation ratio of the common voltage in response to the control signal CS.

The common voltage amplifying unit 186 controls a compensation ratio of the common voltage on the basis of a compensation reference common voltage output from the common voltage compensation unit PVCOM_Ref and a common voltage fed back from a common voltage feedback circuit unit Vcom_FB. The compensation reference common voltage is supplied to a non-inverting terminal (+) of the common voltage amplifying unit 186, the feedback common voltage is supplied to an inverting terminal (−) of the common voltage amplifying unit 186, the first source voltage VDD is supplied to the first bias terminal Vs+, and the low potential voltage GND is supplied to the second bias terminal Vs−.

A gate electrode of the switch unit FET is connected to a control signal line to which the control signal is transferred, a first electrode thereof is connected to an output terminal of the common voltage amplifying unit 186, and a second electrode thereof is connected to the inverting terminal (−) of the common voltage amplifying unit 186. The switch unit FET is turned on or turned off according to a logic state of the control signal CS.

The common voltage feedback circuit unit Vcom_FB is used to compensate for the common voltage. The common voltage feedback circuit Vcom_FB, a circuit positioned outside of the power supply unit, serves to feed back the common voltage, returned through the liquid crystal panel 160 after being output from the power supply unit, to the second circuit unit 180_Vb of the common voltage generation unit 180_V.

The common voltage feedback circuit unit Vcom_FB further includes a first feedback resistor RF1 and a second feedback resistor RF2. The first feedback resistor RF1 is connected to an output terminal of the common voltage feedback circuit unit Vcom_FB at one end thereof, and is connected to the inverting terminal (−) of the common voltage amplifying unit 186 at the other end thereof. The second feedback resistor RF2 is connected to an output terminal of the common voltage generating unit 180_V at one end thereof, and is connected to the inverting terminal (−) of the common voltage amplifying unit 186 at the other end thereof.

As described above, in the second example embodiment of the present disclosure, the compensation ratio of the common voltage Vcom may be varied according to a change in a level of the input voltage, even while the LCD device is being driven, through interworking between the first circuit unit 180_Va and the second circuit unit 180_Vb.

For example, when a voltage level of the input voltage Vin is 2.5V or higher, the common voltage generation unit 180_V may compensate for the common voltage Vcom with a second compensation ratio, which is a normal compensation ratio, and output the same. Meanwhile, when a voltage level of the input voltage Vin is lower than 2.5V, the common voltage generation unit 180_V may compensate for the common voltage Vcom with a first compensation ratio, which is a lowered compensation ratio, and output the same. Here, the first compensation ratio may be M times (M is 1 to 10 times) lower than the second compensation ratio.

For example, when the common voltage generation unit 180_V compensates for the common voltage Vcom with the second compensation ratio, the compensation ratio may be expressed as "COMP RATIO=−RF1/RF2". Here, the common voltage is compensated with the normal compensation ratio which is to be applied to each model of a liquid crystal panel.

Alternatively, when the common voltage generation unit 180_V performs compensation with a third compensation ratio, the compensation ratio may be expressed as "COMP RATIO=0 (FET Ron value)/RF1". Here, the common voltage is not compensated. That is, the compensation ratio is 0, and the common voltage amplifying unit 186 operates as an operational amplifier buffer.

Meanwhile, the common voltage generation unit 180_V may perform a compensation operation with the third compensation ratio (e.g., where common voltage compensation is temporarily stopped), which does not compensate for the common voltage according to a voltage level of the input voltage Vin. In this manner, the compensation ratio of the common voltage may be varied, or compensation may be selectively performed according to a result obtained by comparing the input voltage returning the compensation ratio of the common voltage to the original compensation ratio and the reference voltage of the input voltage provided in the power supply unit.

As described above, the second example embodiment of the present disclosure includes the common voltage generation unit 180_V for varying the compensation ratio (or amplification ratio) of the common voltage Vcom or for not performing compensation.

Therefore, when the common voltage generation unit 180_V according to the second example embodiment is used, the compensation ratio of the common voltage may be varied according to a state (or a level) of the input voltage Vin, or compensation may be temporarily stopped, whereby a voltage margin may be improved and a voltage drop may be resolved, preventing a problem caused by the UVLO being applied to the power supply unit.

In this manner, since the input voltage supplied to the power supply unit or the common voltage generation unit is sensed, a problem related to generation of a special pattern, such as a max pattern, when the LCD device is initially driven or even while the LCD device is normally driven thereafter, may be improved.

Third Example Embodiment

Figure 11:
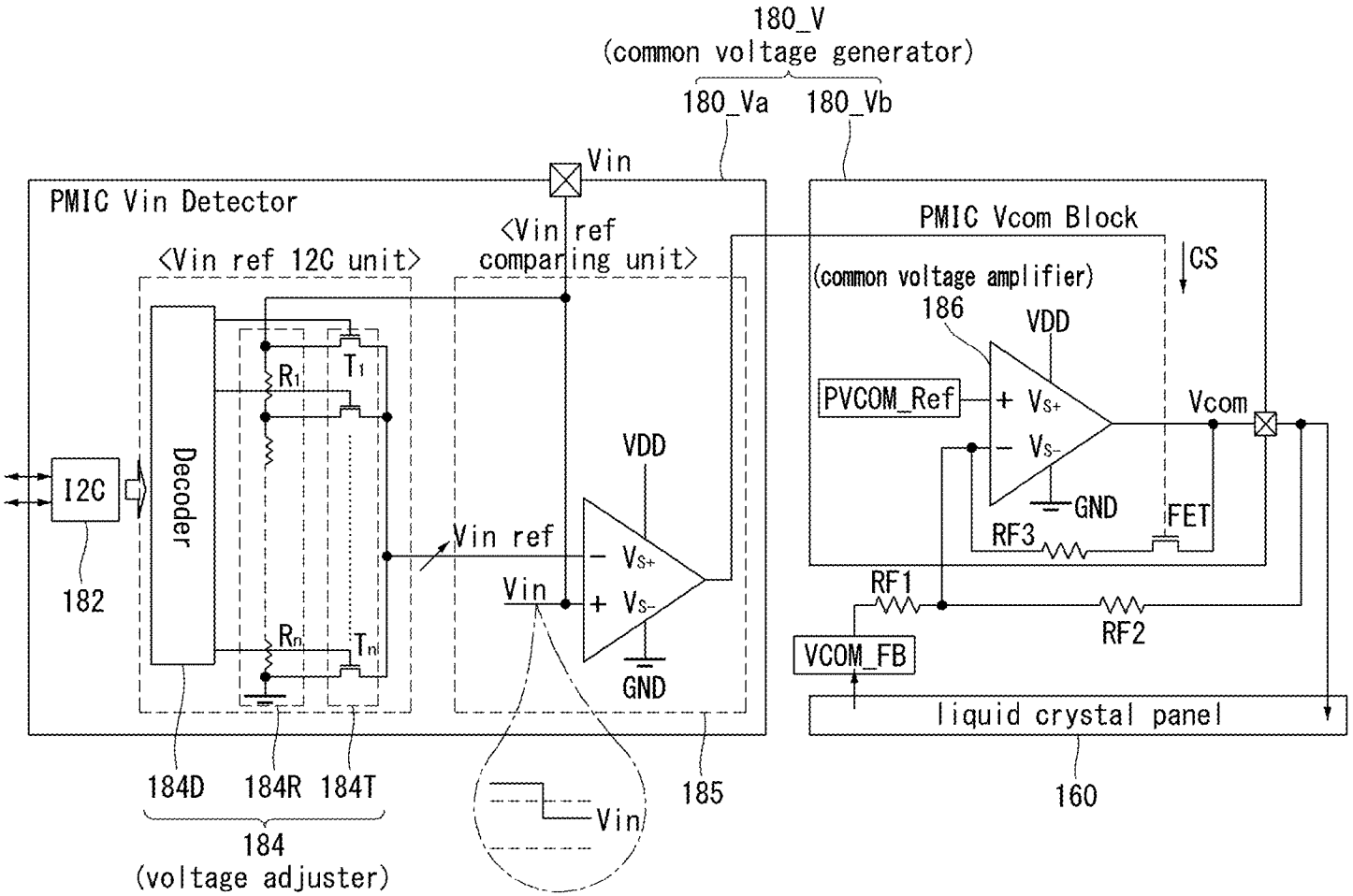
FIG. 11 is a block diagram illustrating an example of a portion of the common voltage generating unit according to a third example embodiment of the present disclosure.

FIG. 11 is a block diagram illustrating a portion of the common voltage generating unit according to a third example embodiment of the present disclosure.

As illustrated in FIG. 11, the example common voltage generation unit 180_V includes a first circuit unit 180_Va (PMIC Vin Detector) detecting an input voltage and a second circuit unit 180_Vb (PMIC Vcom Block) generating a common voltage Vcom.

The first circuit unit 180_Va outputs a control signal CS for controlling a compensation ratio of the common voltage Vcom output from the second circuit unit 180_Vb on the basis of a signal supplied from an external circuit unit and an input voltage Vin supplied from the outside.

The second circuit unit 180_Vb controls a compensation ratio of the common voltage Vcom in response to the control signal CS supplied from the first circuit unit 180_Va. The second circuit unit 180_Vb includes a common voltage amplifying unit 186 amplifying a common voltage and outputting the amplified common voltage, and a switch unit FET controlling a compensation ratio of the common voltage in response to the control signal CS.

The example common voltage generation unit according to the third example embodiment of the present disclosure may be the same as that of the second example embodiment, except for a third feedback resistor RF3 included in the second circuit unit 180_Va. For brevity, only the third feedback resistor RF3 may be described.

The second circuit unit 180_Vb controls a compensation ratio of the common voltage Vcom in response to the control signal CS supplied from the first circuit unit 180_Va. The second circuit unit 180_Vb includes the common voltage amplifying unit 186 amplifying a common voltage and outputting the amplified common voltage, the switch unit FET controlling a compensation ratio of the common voltage in response to the control signal CS, and the third feedback resistor RF3.

Together with the first and second feedback resistors RF1 and RF2, the third feedback resistor RF3 may serve to determine a compensation ratio of the common voltage. The third feedback resistor RF3 may be positioned between the switch unit FET and the inverting terminal (−) of the common voltage amplifying unit 186. The third feedback resistor RF3 may be connected to the second electrode of the switch unit FET at one end, and connected to the inverting terminal (−) of the common voltage amplifying unit 186 at the other end.

As described above, in the third example embodiment of the present disclosure, the compensation ratio of the common voltage Vcom may be varied according to a change in a level of the input voltage, even while the LCD device is being driven, through interworking between the first circuit unit 180_Va and the second circuit unit 180_Vb.

For example, when a voltage level of the input voltage Vin is 2.5V or higher, the common voltage generation unit 180_V may compensate for the common voltage Vcom with a second compensation ratio, (e.g., a normal compensation ratio), and output the same. Meanwhile, when a voltage level of the input voltage Vin is lower than 2.5V, the common voltage generation unit 180_V may compensate for the common voltage Vcom with a first compensation ratio, (e.g., a lowered compensation ratio), and output the same. Here, the first compensation ratio may be M times (M is 1 to 10 times) lower than the second compensation ratio.

For example, when the common voltage generation unit 180_V compensates for the common voltage Vcom with the second compensation ratio, the compensation ratio may be expressed as "COMP RATIO=−RF1/RF2". Here, the common voltage is compensated with the normal compensation ratio which is to be applied to each model of a liquid crystal panel.

In contrast, when the common voltage generation unit 180_V compensates for the common voltage Vcom with the second compensation ratio, the compensation ratio may be expressed as "COMP RATIO=−RF3/RF1". In this case, the common voltage is compensated with a lowered compensation ratio which is to be applied to each model requiring a lower compensation ratio.

As described above, the third example embodiment of the present disclosure includes the common voltage generation unit 180_V for varying the compensation ratio (or amplification ratio) of the common voltage Vcom. In particular, in the third example embodiment, in order to improve a voltage margin, different compensation ratios may be expressed for each input voltage, and also, a drop amount of an input voltage may be adjusted.

Therefore, when the common voltage generation unit 180_V according to the third example embodiment is used, the compensation ratio of the common voltage may be varied according to a state (or a level) of the input voltage Vin, a voltage margin may be improved, and a voltage drop may be resolved, thereby preventing a problem in which UVLO is applied to the power supply unit. Accordingly, reliability and stability of the device may be enhanced.

In this manner, because the input voltage supplied to the power supply unit or the common voltage generation unit is sensed, a problem related to generation of a special pattern such as a max pattern when the LCD device is initially driven, or even while the LCD device is being normally driven thereafter (e.g., in a middle stage of driving), may be improved.

As described above, in example embodiments of the present disclosure, in order to reduce drop of an input voltage when power is turned on at an initial stage, to mainly aim at enhancing a voltage margin when a special pattern such as a max pattern is generated (or expressed), 1) a source voltage of the common voltage amplifying unit is limited, 2) a compensation ratio of the common voltage is lowered or a compensation operation time is delayed when power is turned on, 3) the common voltage amplifying unit is implemented as a compensation circuit or a buffer circuit of a common voltage, and 4) a drop amount of an input voltage is adjusted by differentiating a compensation ratio of the common voltage according to an input voltage.

As described above, in example embodiments, when a special pattern is generated (or expressed), a voltage margin is enhanced and a voltage drop at the input terminal of the power supply unit is prevented, thereby enhancing reliability and stability of the device. Also, even when the special pattern is generated at an initial stage of driving, or while the device is being normally driven thereafter (e.g., at a middle stage of driving), a voltage may be stably output. In addition, display quality may be enhanced by differentiating a common voltage compensation ratio according to a state of the power supply unit and a model of a liquid crystal panel.

It will be apparent to those skilled in the art that various modifications and variations may be made in the display device of the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:
a liquid crystal panel configured to display an image;
a driver configured to drive the liquid crystal panel;
a timing controller configured to control the driver; and
a power supply configured to:
be supplied by an input voltage;
supply a common voltage to the liquid crystal panel; and
temporarily vary a compensation ratio of the common voltage when a pattern causing a drop of the input voltage is displayed by the display device,
wherein the power supply includes a common voltage generator comprising:
a first circuit including a voltage adjuster configured to vary a reference voltage of the input voltage and output the varied reference voltage in response to a first power control signal from the timing controller, and a voltage comparator configured to compare the input voltage and the reference voltage of the input voltage and output an other control signal according to the comparison result; and
a second circuit including a common voltage amplifier configured to amplify the common voltage on the basis of a first source voltage and a low potential voltage and output an amplified common voltage, and a switch configured to control a compensation ratio of the amplified common voltage output from the common voltage amplifier in response to the other control signal supplied from the first circuit.

2. The liquid crystal display device of claim 1, wherein:
the power supply is further configured to:
compensate for the common voltage with a first compensation ratio during a first period of time in which black data and a max pattern are displayed by the liquid crystal panel, and
compensate for the common voltage with a second compensation ratio during a second period of time after the first period of time is terminated; and
the first compensation ratio is lower than the second compensation ratio.

3. The liquid crystal display device of claim 1, wherein
the power supply temporarily lowers the compensation ratio in response to the first power control signal supplied from the timing controller.

4. The liquid crystal display device of claim 1, wherein
the first circuit further comprises
a communication interface configured to communicate with the timing controller and receive the first power control signal from the timing controller.

5. The liquid crystal display device of claim 1, wherein
the voltage adjuster comprises:
a decoder configured to generate an output in response to the first power control signal;
a resistor string between the first source voltage and the low potential voltage; and
a transistor configured to control the resistor string in response to a signal output from the decoder, and vary the first source voltage and output the varied first source voltage.

6. The liquid crystal display device of claim 1, wherein:
the power supply detects the input voltage;
when a level of the input voltage is lower than that of the reference voltage of the input voltage prepared therein, the power supply compensates for the common voltage with the first compensation ratio or temporarily stops compensation of the common voltage;
when the level of the input voltage is higher than that of the reference voltage of the input voltage, the power supply compensates for the common voltage with the second compensation ratio; and
the first compensation ratio is lower than the second compensation ratio.

7. The liquid crystal display device of claim 1, wherein
the common voltage generator comprises:
a common voltage feedback circuit configured to be provided outside to feed back a common voltage returned through the liquid crystal panel to the common voltage amplifier;
a first feedback resistor connected to an output terminal of the common voltage feedback circuit at one end and connected to an inverting terminal of the common voltage amplifier at the other end; and
a second feedback resistor connected to an output terminal of the common voltage generator at one end and connected to an inverting terminal of the common voltage amplifier at the other end.

8. The liquid crystal display device of claim 7, wherein
the common voltage generator further comprises a third feedback resistor connected to a second electrode of the switch at one end and connected to the inverting terminal of the common voltage amplifier at the other end.

* * * * *